US010232626B2

(12) United States Patent
Hasegawa

(10) Patent No.: US 10,232,626 B2
(45) Date of Patent: Mar. 19, 2019

(54) INKJET PRINTER

(71) Applicant: Roland DG Corporation, Hamamatsu-shi, Shizuoka (JP)

(72) Inventor: Hideyuki Hasegawa, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 0 days.

(21) Appl. No.: 15/798,466

(22) Filed: Oct. 31, 2017

(65) Prior Publication Data

US 2018/0126741 A1 May 10, 2018

(30) Foreign Application Priority Data

Nov. 7, 2017 (JP) ..... 2016-217042

(51) Int. Cl.
*B41J 2/17* (2006.01)

(52) U.S. Cl.
CPC ..... *B41J 2/1714* (2013.01)

(58) Field of Classification Search
CPC ..... B41J 2/1714
See application file for complete search history.

(56) References Cited

U.S. PATENT DOCUMENTS

2006/0238561 A1* 10/2006 Carcia ..... B41J 2/165 347/30
2009/0244247 A1* 10/2009 Yamamoto ..... B41J 11/007 347/104
2011/0109693 A1* 5/2011 Ohnishi ..... B41J 2/18 347/34
2012/0001983 A1* 1/2012 Asano ..... B41J 2/1714 347/25
2017/0157959 A1* 6/2017 Arimizu ..... B41J 2/01
2018/0117916 A1* 5/2018 Mitsuo ..... B41J 2/16526

FOREIGN PATENT DOCUMENTS

JP 2007-230034 A 9/2007
JP 2007-331283 A 12/2007
JP 2010-058441 A 3/2010
JP 2010-137483 A 6/2010
JP 2011-143657 A 7/2011

* cited by examiner

*Primary Examiner* — Geoffrey S Mruk
*Assistant Examiner* — Scott A Richmond
(74) *Attorney, Agent, or Firm* — Keating & Bennett, LLP

(57) ABSTRACT

An inkjet printer includes an ejection head that ejects an ink onto a recording medium, a passage in which an ink mist generated by the ejection head flows, a gas-liquid separator that is located in a portion of the passage and separates ink and air from the ink mist, and a blower that is located in the passage and causes the ink mist to be moved away from the ejection head to the gas-liquid separator. A downstream side of the gas-liquid separator is above an upstream side of the gas-liquid separator in a gravitational direction.

16 Claims, 7 Drawing Sheets

INKJET PRINTER

CROSS REFERENCE TO RELATED APPLICATIONS

This application claims the benefit of priority to Japanese Patent Application No. 2016-217042 filed on Nov. 7, 2016. The entire contents of this application are hereby incorporated herein by reference.

BACKGROUND OF THE INVENTION

1. Field of the Invention

The present invention relates to an inkjet printer.

2. Description of the Related Art

An inkjet printer ejects inks from nozzles of ejection heads to form an image on a recording medium. At this time, a portion of the inks ejected from the nozzles may turn into fine ink mist and float inside the printer, especially around the ejection heads. When such ink mist adheres to the recording medium, the image quality may be deteriorated. The ink mist may also cause clogging of the nozzles of the ejection heads.

Conventionally, various measures have been taken to prevent such problems (refer to JP-A-2011-143657, JP-A-2010-137483 and JP-A-2010-058441). For example, JP-A-2011-143657 discloses a printer in which an airstream generation mechanism is installed between ejection heads and a recording medium. In the printer of JP-A-2011-143657, ink mist generated during printing is directed by the airstream generation mechanism to a position away from the ejection heads and the recording medium. Then, air containing the ink mist is discharged from a discharge part provided in the rear face of the printer through a filter. JP-A-2010-137483 discloses a printer including ejection heads each provided with a mist suction removal mechanism having an air suction mechanism and an air blow mechanism. In the printer of JP-A-2010-137483, the air blow mechanism generates an airstream that flows from the recording medium side to the ejection head side. Then, ink mist generated during printing is sucked by the air suction mechanism and trapped by a filter included in the ejection head.

However, when air is discharged to the outside of the printer as described in JP-A-2011-143657, the air pressure in the printer decreases and surrounding air blows into the printer. This causes contamination of printed images with dust which results in deterioration of image quality. When a mist suction removal mechanism is provided on the ejection heads as described in JP-A-2010-137483, the structure of the ejection heads or a carriage on which the ejection heads are mounted becomes complicated in general. This leads to an increase in size and weight of the printer. In addition, the air-permeability and the ability to trap ink mist of a filter are mutually exclusive. For example, when the density of the filter is increased to improve its ability to trap ink mist, the air-permeability of the filter decreases and an excessive burden may be placed on the motor used to suck air.

SUMMARY OF THE INVENTION

Preferred embodiments of the present invention provide printers that prevent contamination of printed images with dust and trap ink mist efficiently.

An inkjet printer according to a preferred embodiment of the present invention includes an ejection head that ejects an ink onto a recording medium, a passage in which an ink mist generated by the ejection head flows, a gas-liquid separator that is located in a portion of the passage and separates ink and air from the ink mist, and a blower that is located in the passage and causes the ink mist to be moved away from the ejection head to the gas-liquid separator, wherein a downstream side of the gas-liquid separator is above an upstream side of the gas-liquid separator in a gravitational direction.

In the inkjet printer with the above configuration, air containing ink mist generated during printing is sent to the gas-liquid separator that may be located in an external space outside of a cover. The ink mist is separated into air and ink. Then, clean air after the removal of ink from the ink mist is returned to an internal space inside the cover. This configuration reduces the effect of dust or ink mist to improve the printing quality. In other words, the external space outside the cover is less likely to retain heat and has a relatively lower temperature than the internal space. Because the gas-liquid separator is installed in the external space, the ink mist tends to be cooled to form aggregate particles with a larger particle size. As a result, the gas-liquid separator readily separates and collects ink mist. For example, ink mist in the air is able to be removed more efficiently compared to the case where a filter is installed in the internal space. In addition, the configuration of the printer (the ejection head, for example) is thus able to be simpler. Further, because the air after the removal of ink from the ink mist is returned to the internal space, a pressure difference is less likely to be created between the inside and outside of the cover. This configuration prevents air from blowing into the internal space from the spaces around the printer. As a result, entry of dust into the internal space is significantly reduced or prevented.

According to inkjet printers of various preferred embodiments of the present invention, contamination of printed image with dust is significantly reduced or prevented and ink mist is able to be trapped efficiently, resulting in the improvement of printing quality.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
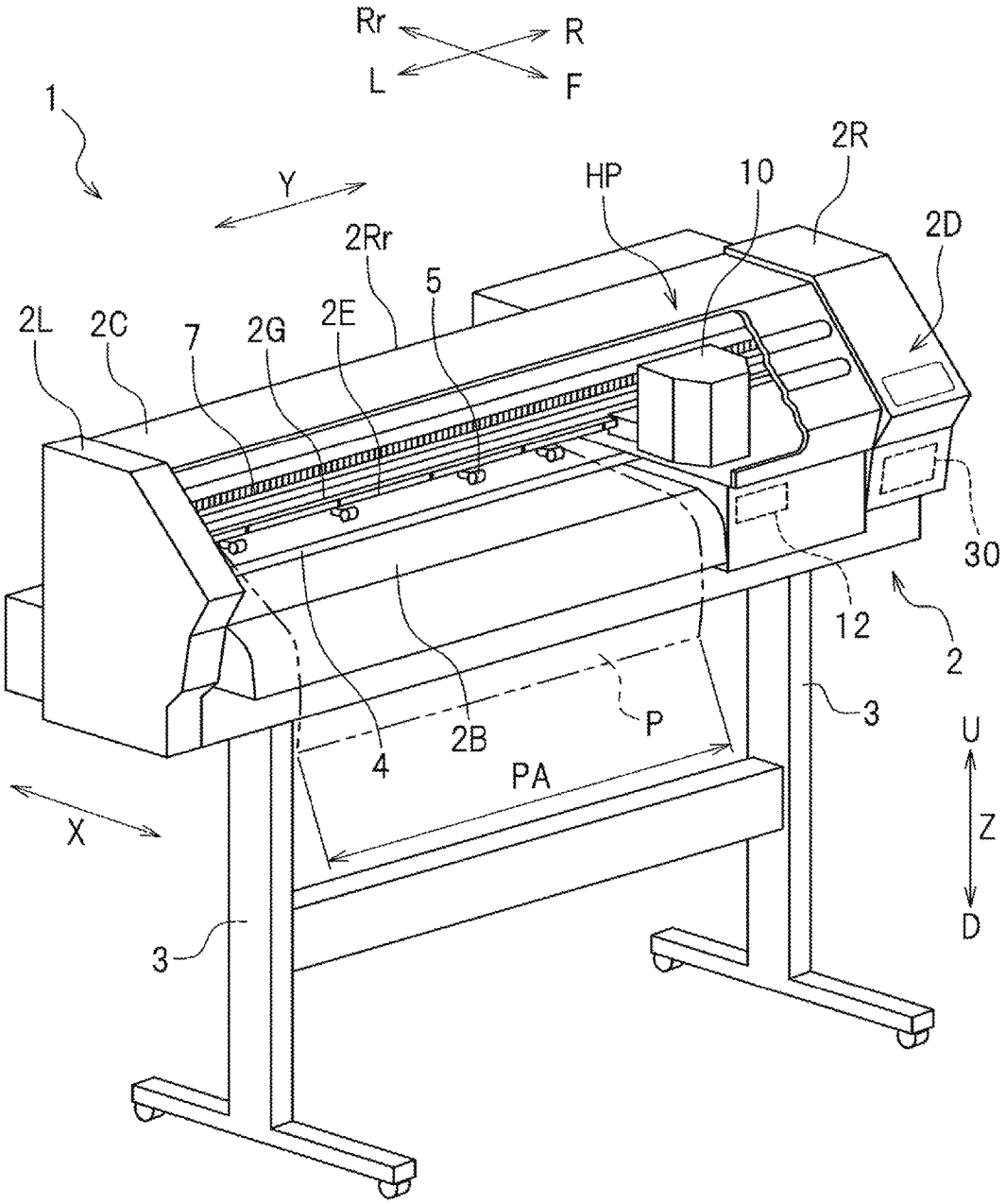
FIG. 1 is a partially cut-away schematic perspective view, illustrating an inkjet printer of a preferred embodiment according to the present invention.

Description is hereinafter made of preferred embodiments of the present invention with reference to the drawings. It should be understood that the preferred embodiments described herein are not particularly intended to limit the present invention. In addition, members and elements that have the same functions are denoted by the same reference numerals or symbols and redundant description is omitted or simplified as appropriate.

The term "inkjet system" as used herein is a term that includes printing methods using any conventionally known inkjet technique including continuous systems, such as binary deflection systems or continuous deflection systems, and on-demand systems, such as thermal systems or piezoelectric systems.

First Preferred Embodiment

Figure 2:
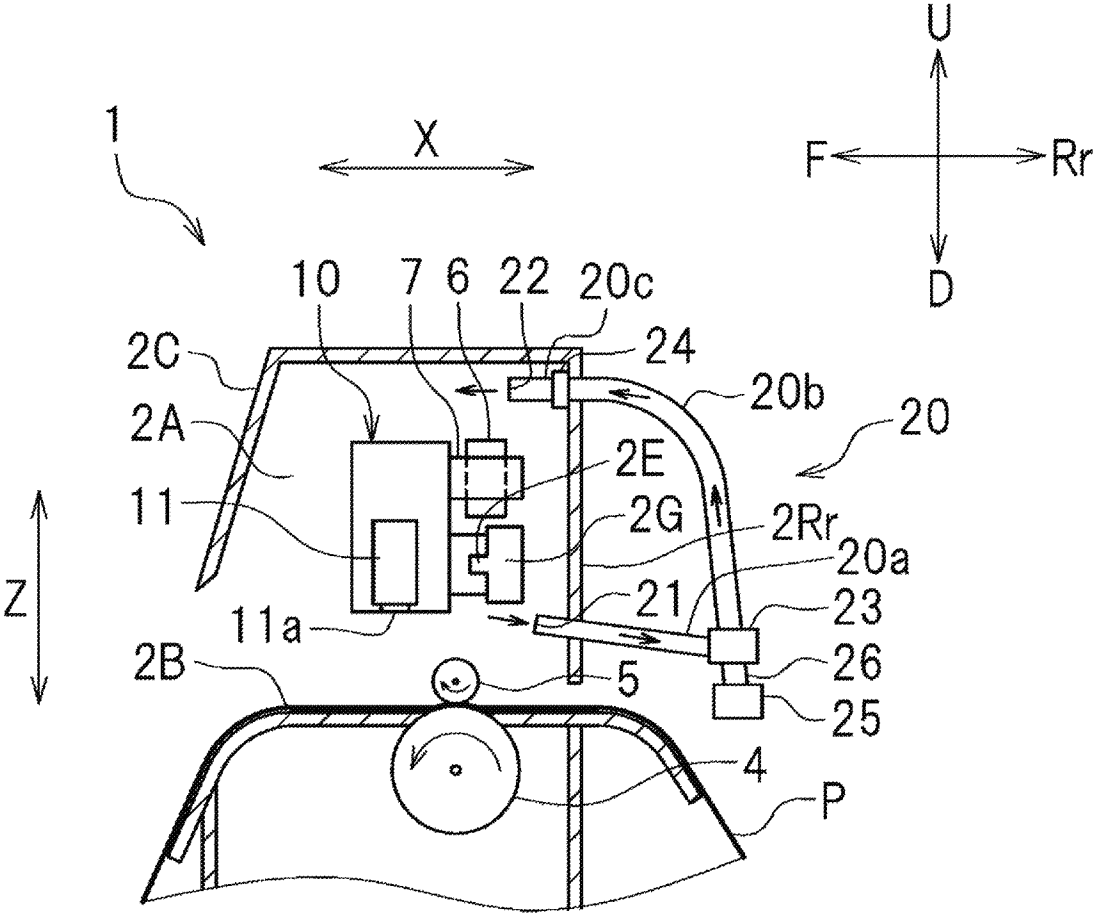
FIG. 2 is a cross-sectional view in a sub-scanning direction, schematically illustrating a portion of the inkjet printer of FIG. 1.

First, an inkjet printer (which may be hereinafter referred to simply as "printer") 1 is described. FIG. 1 is a partially cut away schematic perspective view, illustrating a wide-format printer 1 according to a preferred embodiment of the present invention. FIG. 2 is a cross-sectional view in a sub-scanning direction X, schematically illustrating a portion of the printer 1. In the following drawings, the reference symbol Y represents the main scanning direction, the reference symbol X represents the sub-scanning direction, which is perpendicular to the main scanning direction Y, and the reference symbol Z represents a gravitational direction (vertical direction). The reference symbols F, Rr, L, R, U and D represents front, rear, left, right, up and down, respectively. However, these are given for convenience of description, and do not at all limit the installation mode of the printer 1.

The printer 1 is preferably used to print an image on a recording medium P, for example. The recording medium P is an object on which an image is printed. The recording medium P is not limited to particular media. The recording medium P may be paper such as normal paper or inkjet printing paper, or a resin, metal, glass, rubber or the like, for example.

The printer 1 includes a printer main unit 2, two stands 3 that support the printer main unit 2, and a controller 30. The printer main unit 2 extends in the main scanning direction Y. The printer main unit 2 includes a platen 2B, a left wall portion 2L and a right wall portion 2R, a rear wall portion 2Rr, a top cover 2C, and a guide rail 2G.

The platen 2B defines a lower side of the printer main unit 2. The platen 2B is fixed to the stands 3. The platen 2B extends in the main scanning direction Y. The left wall portion 2L defines a left side of the printer main unit 2. The right wall portion 2R defines a right side of the printer main unit 2. The platen 2B, the rear wall portion 2Rr and the guide rail 2G are coupled to the left wall portion 2L and the right wall portion 2R. The left wall portion 2L and the right wall portion 2R extend in the sub-scanning direction X, i.e., perpendicularly or substantially perpendicularly to the platen 2B, the rear wall portion 2Rr and the guide rail 2G. An operation panel 2D is provided on a front surface of the right wall portion 2R. The rear wall portion 2Rr defines a rear side of the printer main unit 2. The top cover 2C is disposed above the platen 2B. The platen 2B is covered with the top cover 2C from above. The top cover 2C can be freely opened and closed, and defines upper and front sides of the printer main unit 2. The region surrounded by the platen 2B, the left wall portion 2L and the right wall portion 2R, the rear wall portion 2Rr and the top cover 2C is a printing space 2A (refer to FIG. 2). In this preferred embodiment, the printing space 2A is an internal space inside the top cover 2C.

The platen 2B has a printable region PA at its central portion in the main scanning direction Y (the right-left direction of FIG. 1). The recording medium P is placed on the printable region PA of the platen 2B. In this preferred embodiment, the platen 2B is a mount table on which the recording medium P is placed. The recording medium P is transported in the sub-scanning direction X (the front-rear direction of FIG. 1) by a paper feed mechanism (not shown). The platen 2B is provided with a cylindrical grid roller 4. The grid roller 4 is embedded in the platen 2B with its upper surface exposed. The grid roller 4 is electrically connected to a feed motor (not shown). The grid roller 4 is driven to rotate by the feed motor. The feed motor is controlled by the controller 30. Pinch rollers 5 are installed above the grid roller 4. The pinch rollers 5 press the recording medium P from above. The pinch rollers 5 are opposed to the grid roller 4. When the grid roller 4 rotates with the recording medium P pinched between the grid roller 4 and the pinch rollers 5, the recording medium P is transported in the sub-scanning direction X.

The guide rail 2G is fixed to the left wall portion 2L and the right wall portion 2R. The guide rail 2G extends in the main scanning direction Y. The guide rail 2G includes an engagement portion 2E protruding forward. A carriage 10 is in engagement with the engagement portion 2E of the guide rail 2G. The guide rail 2G and the carriage 10, which is in engagement with the guide rail 2G, are covered with the top cover 2C from above. The carriage 10 is slidable in the main scanning direction Y (the right-left direction of FIG. 1) along the guide rail 2G. Pulleys 6 (refer to FIG. 2) are installed at both right and left ends of the guide rail 2G. An endless belt 7 is entrained around the two pulleys 6. One of the pulleys 6 is electrically connected to a carriage motor (not shown). The pulley 6 is driven to rotate by the carriage motor. The carriage motor is controlled by the controller 30. When the pulley 6 is rotated and the belt 7 runs, the carriage 10 is moved in the main scanning direction Y.

When a printing operation is not in progress, the carriage 10 is standing by in a home position HP at a right end of the guide rail 2G. The carriage 10 includes an ejection head 11 (refer to FIG. 2). The ejection head 11 is communicated with an ink cartridge (not shown) via an ink supply passage (not shown). The ink cartridge is detachably attached to the inside of the right wall portion 2R, for example. The ink contained in the ink cartridge is not limited to particular inks. For example, the ink may be a solvent-based pigment ink or aqueous pigment ink, or may be an aqueous dye ink, ultraviolet-curable pigment ink or the like, for example.

The ejection head 11 includes a plurality of nozzles 11*a* that eject the ink in a surface to be opposed to the recording medium P (a lower surface, in this preferred embodiment). An actuator (not shown) including a piezoelectric element or the like is provided in the ejection head 11. The actuator is controlled by the controller 30. When the actuator is driven, the ink is ejected from the nozzles 11*a* of the ejection head 11 onto the recording medium P.

Figure 3:
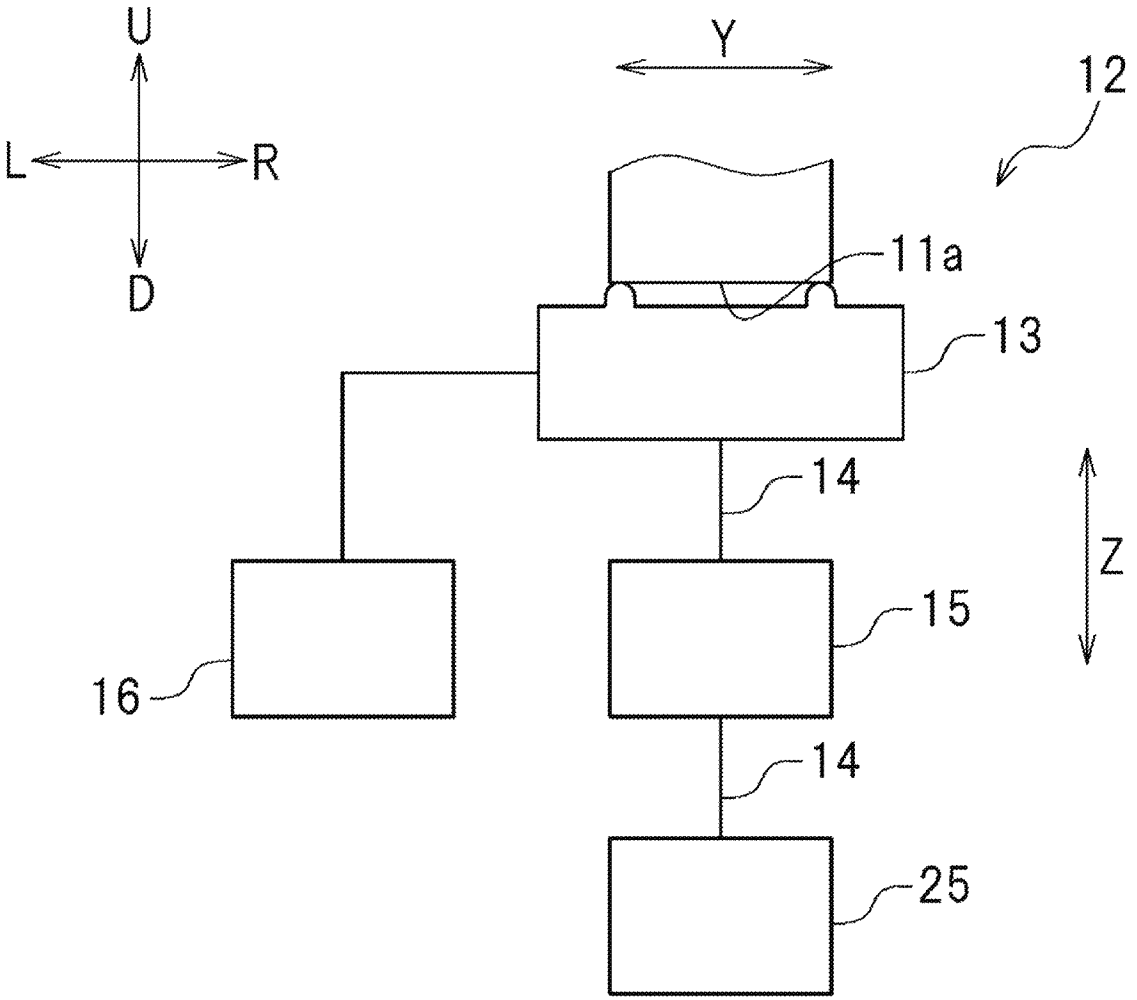
FIG. 3 is a cross-sectional view in a main scanning direction, schematically illustrating one example of a flusher.

A flusher 12 is disposed, below the home position, inside the printer main unit 2. FIG. 3 is a cross-sectional view in the main scanning direction Y, schematically illustrating one example of the flusher 12. FIG. 3 illustrates a state where a cap 13 has been attached to the nozzles 11*a* of the ejection head 11. The flusher 12 of this preferred embodiment includes the cap 13, a suction pump 15, and a cap movement mechanism 16. The cap 13 is disposed to cover the nozzles 11*a*. The suction pump 15 sucks the ink in the ejection head 11. The cap movement mechanism 16 is a movement mechanism that moves the cap 13 in the vertical direction Z. The cap movement mechanism 16 includes a motor, for example.

When the carriage 10 is standing by in the home position HP, the cap 13 is located at an upper position in the vertical direction Z by the cap movement mechanism 16. Thus, the nozzles 11*a* of the ejection head 11 in the carriage 10 are covered with the cap 13 to prevent the ink in the nozzles 11*a* from drying. The cap 13 is communicated with a waste tank 25 via a first waste ink passage 14. The suction pump 15 is installed in an intermediate portion of the first waste ink passage 14. For example, the first waste ink passage 14 is a flexible tube. When the suction pump 15 is driven with the nozzles 11*a* of the ejection head 11 covered with the cap 13, the ink in the ejection head 11 is sucked through the cap 13.

The ink discharged from the ejection head 11 is collected in the waste tank 25. The waste tank 25 is made from a resin with improved ink resistance such as polypropylene (PP), for example. In this preferred embodiment, the waste tank 25 is directly or indirectly supported by the rear wall portion 2Rr of the printer main unit 2. The waste tank 25 preferably is not mounted on the carriage 10. The waste tank 25 preferably is installed outside the printer main unit 2. However, the waste tank 25 may be installed inside the printer main unit, for example, inside the platen 2B.

As shown in FIG. 2, an air passage 20 protrudes from the rear wall portion 2Rr of the printer main unit 2. In other words, at least a portion of the air passage 20 is disposed outside the printer main unit 2, i.e., in an external space outside the top cover 2C. The air passage 20 preferably is provided integrally with the printer main unit 2. The air passage 20 is a flow path through which the air retained in the printing space 2A in the printer main unit 2 is circulated. In FIG. 2, the direction in which the air flows (air flowing direction) is indicated by arrows. The air passage 20 preferably has excellent ink resistance and ink repellency. For example, the air passage 20 is made from a resin such as polypropylene or fluororesin or a metal such as copper, stainless or aluminum.

The air passage 20 includes at one end an air intake port 21 through which air is introduced from the printing space 2A in the printer main unit 2. The air passage 20 includes at the other end an air discharge port 22 through which air is discharged into the printing space 2A in the printer main unit 2. In this preferred embodiment, the air intake port 21 and the air discharge port 22 are both disposed in the printing space 2A in the printer main unit 2. The air passage 20 extends through the rear wall portion 2Rr of the printer main unit 2 on the air intake port 21 side and the air discharge port 22 side. However, the air intake port 21 and/or the air discharge port 22 may be directly provided, for example, in a wall defining the printing space 2A in the printer main unit 2, specifically, the platen 2B, the rear wall portion 2Rr, the left wall portion 2L, the right wall portion 2R, the top cover 2C or the like.

Ink mist containing air and ink in the printing space 2A flows in through the air intake port 21. The air intake port 21 is preferably disposed in the vicinity of the ejection head 11 or a recording medium P placed on the platen 2B. In this preferred embodiment, the air intake port 21 is between an upper end of the platen 2B and a lower end of the ejection head 11 in the gravitational direction Z. The air intake port 21 preferably opens in a direction parallel or substantially parallel to the platen 2B. Here, the platen 2B extends in a front-rear direction and in a right-left direction, and the air intake port 21 opens forward. Thus, ink mist that is generated when the ejection head 11 ejects the ink is efficiently directed toward the air passage 20.

After the removal of ink from the ink mist, clean air is discharged through the air discharge port 22. In this preferred embodiment, the air discharge port 22 is disposed above the air intake port 21 in the gravitational direction Z. Because ink in the ink mist is heavier than air, the ink is able to be effectively prevented from reentering the printing space 2A when the air discharge port 22 is positioned relatively higher. In addition, the air discharge port 22 is installed above the upper end of the ejection head 11 in the gravitational direction Z. The air discharge port 22 preferably opens in a direction parallel or substantially parallel to the platen 2B or toward the top of the printer main unit 2 (in other words, toward the top cover 2C). Here, the platen 2B extends in a front-rear direction and in a right-left direction, and the air discharge port 22 opens forward. This configuration reduces the effect of air stream on the ejection head 11.

Figure 4:
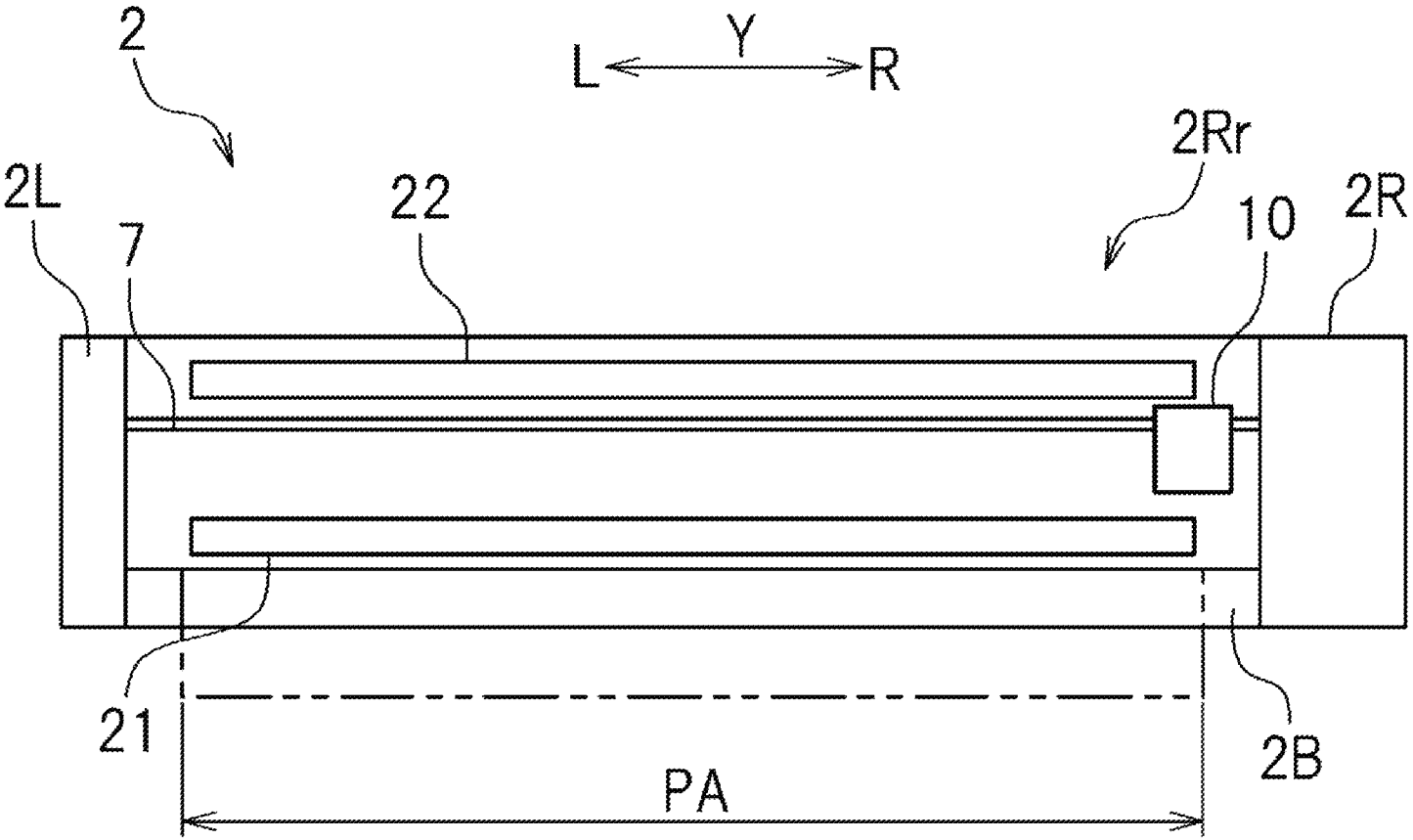
FIG. 4 is a front view, schematically illustrating a printer main unit of FIG. 1.

FIG. 4 is a front view, schematically illustrating the printer main unit 2. In FIG. 4, a state where the top cover 2C has been removed is shown. In FIG. 4, the air intake port 21 extends in a strip-shaped (slot-shaped) configuration in the main scanning direction Y. Because the air intake port 21 extends in the main scanning direction Y, air containing ink mist is able to be effectively drawn from a wide range in the main scanning direction Y along the recording medium P. As shown in FIG. 4, the air discharge port 22 also extends in a strip-shaped (slot-shaped) configuration in the main scanning direction Y. Because the air intake port 21 extends in the main scanning direction Y, the flow rate of the discharged air is able to be decreased to reduce the effect of air stream on the ejection head 11.

The length of the air intake port 21 in the main scanning direction Y may be shorter than, equal to or longer than the length of the printable region PA of the platen 2B, for example. The length of the air intake port 21 in the vertical direction Z may be shorter than, equal to or longer than the length from the upper end of the platen 2B to the lower end of the ejection head 11, for example.

The length of the air discharge port 22 in the main scanning direction Y may be shorter than, equal to or longer than the length of the printable region PA of the platen 2B, for example. The air discharge port 22 may be disposed in the top cover 2C.

A gas-liquid separator 23 and a blower 24 are installed in an intermediate portion of the air passage 20. In this preferred embodiment, the blower 24 is disposed downstream of the gas-liquid separator 23 in the air flowing direction. The air passage 20 in this preferred embodiment includes a first passage 20*a*, a second passage 20*b*, and a third passage 20*c*. A portion of the first passage 20*a*, a portion of the second passage 20*b*, and a portion of the third passage 20*c* preferably are disposed outside the printer main unit 2.

The first passage 20*a* communicates the air intake port 21 with the gas-liquid separator 23. Ink mist including air and ink flows through the first passage 20*a*. The first passage 20*a* extends straight in a linear configuration from the air intake port 21 to the gas-liquid separator 23. Because ink mist tends to travel straight, it usually moves along a straight path through the air passage 20. Because the first passage 20*a* extends in a linear configuration, ink mist is able to be efficiently directed to the gas-liquid separator 23. Thus, ink mist is prevented from flowing back toward the printing space 2A or adhering to and staying on the wall of the first passage 20*a*. In this preferred embodiment, the first passage 20*a* is inclined downward as it extends away from the printer main unit 2. However, the first passage 20*a* may be parallel or substantially parallel to a surface of the platen 2B of the printer main unit 2, for example. The second passage 20*b* communicates the gas-liquid separator 23 with the blower 24. The third passage 20*c* communicates the blower 24 with the air intake port 21. After the removal of ink from the ink mist, clean air flows through the second passage 20*b* and the third passage 20*c*.

The blower 24 is installed in the air passage 20 and sends the air sucked through the air intake port 21 in the air flowing direction, i.e., in a direction toward the air discharge port 22. Only one blower 24 may be provided or two or more blowers 24 may be provided, for example. In this preferred embodiment, the blower 24 is disposed downstream of the gas-liquid separator 23 in the air flowing direction, in other words, closer to the air discharge port 22 than the gas-liquid separator 23 is. This configuration prevents the blower 24 from being contaminated with ink mist to improve the service life of the blower 24. For example, the blower 24 is preferably an air discharge fan that discharges the air separated by the gas-liquid separator 23 (clean air after the removal of ink from the ink mist) into the printing space 2A in the printer main unit 2. However, the blower 24 may be disposed upstream of the gas-liquid separator 23 in the air flowing direction. In this case, the blower 24 is preferably an air intake fan that draws ink mist including air and ink from the printing space 2A in the printer main unit 2. One or more air intake fans and one or more air discharge fans may be disposed upstream and downstream, respectively, of the gas-liquid separator 23 as the blowers 24, for example.

In this preferred embodiment, the blower 24 is disposed in the printing space 2A in the printer main unit 2. However, the blower 24 may be embedded in the rear wall portion 2Rr of the printer main unit 2, or may be disposed in the air passage 20 outside the printer main unit 2, for example. The blower 24 may be any type of blower, and can be selected as appropriate in view of the air volume and air pressure in blowing air, the air flowing direction and so on. For example, the blower 24 preferably is a multi-blade fan (sirocco fan), turbo fan, propeller fan, cross-flow fan (circulating fan), or the like. The blower 24 includes a motor (not shown). The motor of the blower 24 is controlled by the controller 30. The blower 24 is switched on and off in synchronization with ON/OFF of the power source of the printer 1. For example, the blower 24 may be switched on and off in synchronization with opening and closing of the top cover 2C.

The gas-liquid separator 23 is disposed in the air passage 20, and separates ink and air from the ink mist in the printing space 2A in the printer main unit 2. The gas-liquid separator 23 separates the ink mist into air and ink. The air (clean air after the removal of ink from the ink mist) separated by the gas-liquid separator 23 is returned into the printing space 2A in the printer main unit 2 through the second passage 20*b* and the third passage 20*c*. The gas-liquid separator 23 preferably is installed outside the printer main unit 2, in other words, in an external space outside the top cover 2C. The gas-liquid separator 23 is not mounted on the carriage 10. The ink from the ink mist is cooled before it reaches the gas-liquid separator 23 through the first passage 20*a* and forms large aggregates. Thus, the gas-liquid separator 23 separates and removes ink from the ink mist with high efficiency.

The gas-liquid separator 23 may be any type of mechanism. For example, the gas-liquid separator 23 can be selected as appropriate in view of the particle size of ink mist, cost and so on. For example, the gas-liquid separator 23 includes one or two or more conventionally known gas-liquid separators (not shown) such as mesh-shaped separation filters, centrifugal separators, surface tension separators, gravity separators, coalescers, and labyrinth structures. The gas-liquid separators preferably have excellent ink resistance and thermal conductivity. For example, the gas-liquid separators are made from a metal, such as copper, stainless steel or aluminum, resin, ceramic, or the like. From the standpoint of thermal conductivity, the gas-liquid separators are preferably made from a metal. From the standpoint of improving the ability to trap ink from the ink mist, the gas-liquid separator 23 preferably includes a plurality of gas-liquid separators aligned in the air flowing direction. The plurality of gas-liquid separators preferably are able to trap ink particles with different sizes. The gas-liquid separator 23 may include a cooler that promotes aggregation of ink from the ink mist.

The gas-liquid separator 23 is communicated with the waste tank 25 via a second waste ink passage 26. For example, the second waste ink passage 26 is a flexible tube. At least a portion of the ink trapped in the gas-liquid separator 23 is collected into the waste tank 25 in the form of a liquid. This configuration prevents the separated and collected ink from staying in the air passage 20 and impairing airflow and prevents the gas-liquid separation equipment from undergoing breakthrough, ensuring stable gas-liquid separation over a long period of time. Here, the ink separated and collected by the gas-liquid separator 23 and the ink discharged from the ejection head 11 by the flusher 12 are collected in the same waste tank 25. However, the ink separated and collected by the gas-liquid separator 23 and the ink discharged from the ejection head 11 by the flusher 12 may be collected in different waste tanks.

The controller 30 preferably controls the entire operation of the printer 1. The controller 30 preferably is disposed inside the right wall portion 2R. The controller 30 is communicably connected to the feed motor, the carriage motor, the actuator, the suction pump 15, the cap movement mechanism 16, and the motor of the blower 24, and is configured or programmed to be able to control these elements. The controller 30 may have any configuration. For example, the controller 30 may include or be defined by a microcomputer. The microcomputer may have any hardware configuration, but preferably includes, for example, an interface (I/F) through which it receives print data and so on from an external device such as a host computer, a central processing unit (CPU) that executes instructions from control programs, a ROM (read only memory) in which programs that are executed by the CPU are stored, a RAM (random access memory) that is used as a working area in which the programs are developed, and a storage device, such as a memory, in which the program and various data are stored.

The printing operation using the printer 1 is now described. Prior to printing with the printer 1, the user switches ON the power source of the printer 1. In synchronization with this, the controller 30 drives the motor of the blower 24 so that the air in the printing space 2A is circulated through the air passage 20. In addition, the controller 30 drives the cap movement mechanism 16 to remove the cap 13 from the ejection head 11. To the controller 30, image data to be printed are sent from an external computer (not shown). Based on the image data, the controller 30 drives the carriage motor to move the carriage 10 in the main scanning direction Y and drives the actuator to cause the ejection head 11 to eject the ink onto the printing surface of the recording medium P. As a result, an image is formed on the recording medium P.

During the above printing operation, a portion of the ink ejected from the ejection head 11 floats in the printing space 2A in the form of fine ink mist. The ink mist in the printing space 2A is sent to the gas-liquid separator 23 through the first passage 20*a*. The gas-liquid separator 23 preferably is installed outside the printer main unit 2. The gas-liquid separator 23 separates the ink mist into air and ink. The air separated by the gas-liquid separator 23 is returned again to the printing space 2A through the second passage 20*b* and the third passage 20*c*.

As described above, in the printer 1, the gas-liquid separator 23 preferably is installed outside the printer main unit 2. Thus, the ink mist is cooled and the ink from the ink mist aggregates easily. This configuration enhances the ability of the gas-liquid separator 23 to trap ink from the ink mist and enables its air permeability and ability to trap ink from the ink mist to be balanced at a high level. For example, when a gas-liquid separator having trapping performance comparable to that of conventional gas-liquid separators is used, the ink trapping and collecting efficiencies are improved compared to the conventional gas-liquid separators. Alternatively, even when a gas-liquid separator having trapping performance lower than that of conventional gas-liquid separators is used, ink from the ink mist is able to be trapped at an equal level with the conventional gas-liquid separators. In addition, because the air-permeability is improved by lowering the trapping performance, the output power of the motor of the blower 24 is able to be set lower. Thus, the printer 1 reduces the effects of ink from the ink mist to improve the printing quality.

In addition, in the printer 1, the air separated by the gas-liquid separator 23 is returned again to the printing space 2A. Thus, a pressure difference is less likely to be created between the inside and outside of the printing space 2A. This configuration prevents air from blowing into the printing space 2A from the spaces around the printer main unit 2. As a result, printed images are prevented from being contaminated with dust.

In this preferred embodiment, the blower 24 is installed downstream of the gas-liquid separator 23 in the air flowing direction in the air passage 20. This configuration prevents the blower 24 from being contaminated with ink from the ink mist to improve the service life of the blower 24.

In this preferred embodiment, the air discharge port 22 is disposed above the air intake port 21 in the gravitational direction. Ink from the ink mist is usually heavier than air. Because the air discharge port 22 is positioned relatively higher, ink from the ink mist is able to be effectively prevented from reentering the printing space 2A.

In this preferred embodiment, the platen 2B, which is at least partially located in the printing space 2A and on which a recording medium P is placed, is provided. The ejection head 11 is disposed above the platen 2B in the gravitational direction. This configuration enables the techniques disclosed herein to achieve advantageous effects more effectively.

In this preferred embodiment, the air intake port 21 preferably is at least partially located between the upper end of the platen 2B and the lower end of the ejection head 11 in the gravitational direction. This configuration enables ink mist generated when the ejection head 11 ejects the ink to be efficiently sucked and directed toward the air passage 20.

In this preferred embodiment, the air discharge port 22 is located above the upper end of the ejection head 11 in the gravitational direction. This configuration prevents the air reflowing into the printing space 2A from directly hitting the nozzles 11*a* of the ejection head 11. Thus, the effect of airstream on the ejection head 11 during ink ejection is able to be reduced.

In this preferred embodiment, the gas-liquid separator 23 is communicated with the waste tank 25, into which the separated ink from the ink mist is collected. This configuration prevents the separated and collected ink from staying in the air passage 20 and impairing airflow and prevents the gas-liquid separation equipment from undergoing breakthrough, ensuring stable gas-liquid separation over a long period of time.

Second Preferred Embodiment

Figure 5:
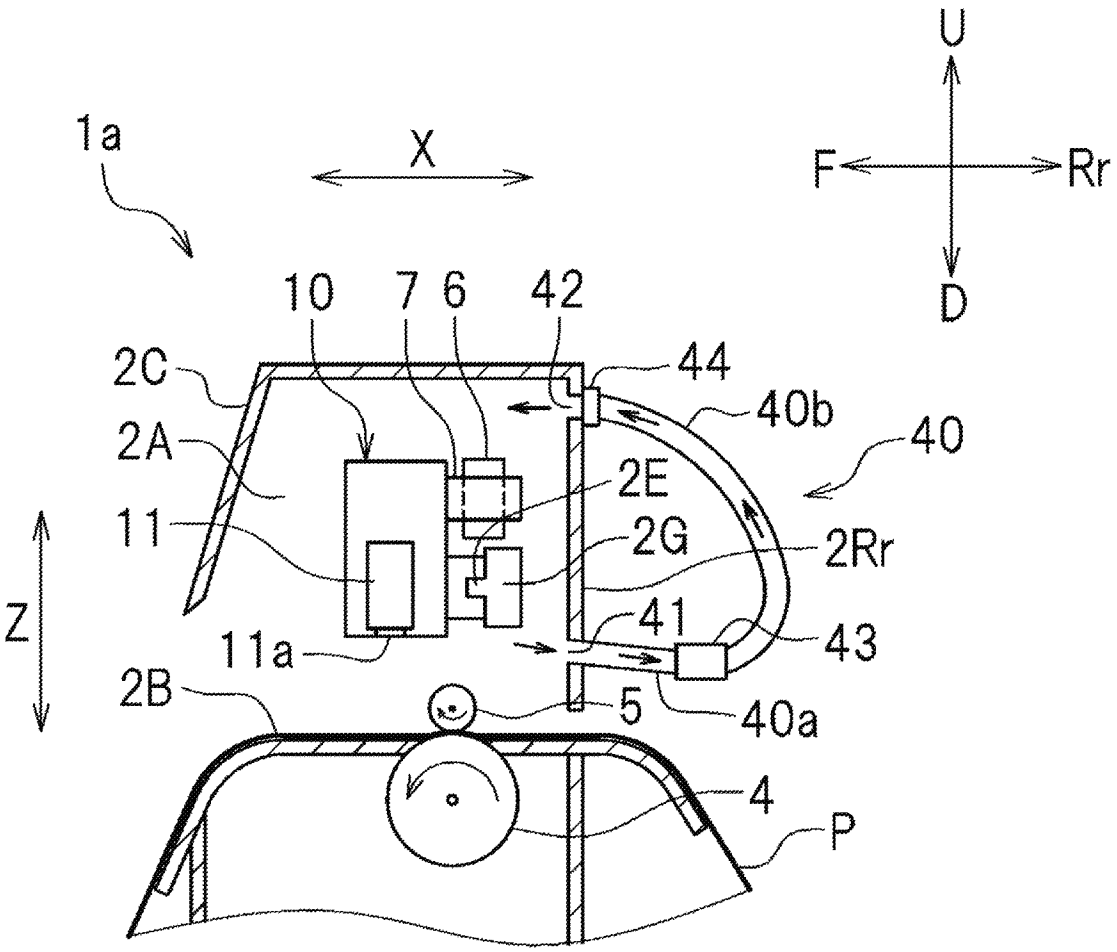
FIG. 5 is a cross-sectional view in the sub-scanning direction, schematically illustrating a portion of an inkjet printer according to another preferred embodiment of the present invention.

A printer 1*a* according to a second preferred embodiment of the present invention is obtained by modifying the configuration of the air passage 20, the gas-liquid separator 23 and the blower 24 of the printer 1 of the first preferred embodiment. As shown in FIG. 5, an air passage 40 protrudes from a rear side of the printer 1*a* of the second preferred embodiment. In the gravitational direction Z, the air passage 40 includes an air intake port 41 at its lower end and an air discharge port 42 at its upper end. In this preferred embodiment, the air intake port 41 and the air discharge port 42 preferably are directly disposed in the rear wall portion 2Rr of a printer main unit 2A. A gas-liquid separator 43 and a blower 44 are installed in an intermediate portion of the air passage 40. The air passage 40 includes a first passage 40*a* communicating the air intake port 41 with the gas-liquid separator 43, and a second passage 40*b* communicating the gas-liquid separator 43 with the blower 44. The first passage 40*a* and the second passage 40*b* preferably are disposed outside the printer main unit 2A. The blower 44 preferably is installed outside the printer main unit 2A in the air passage 20. The blower 44 preferably is directly supported on the rear wall portion 2Rr of the printer main unit 2A.

Figure 6:
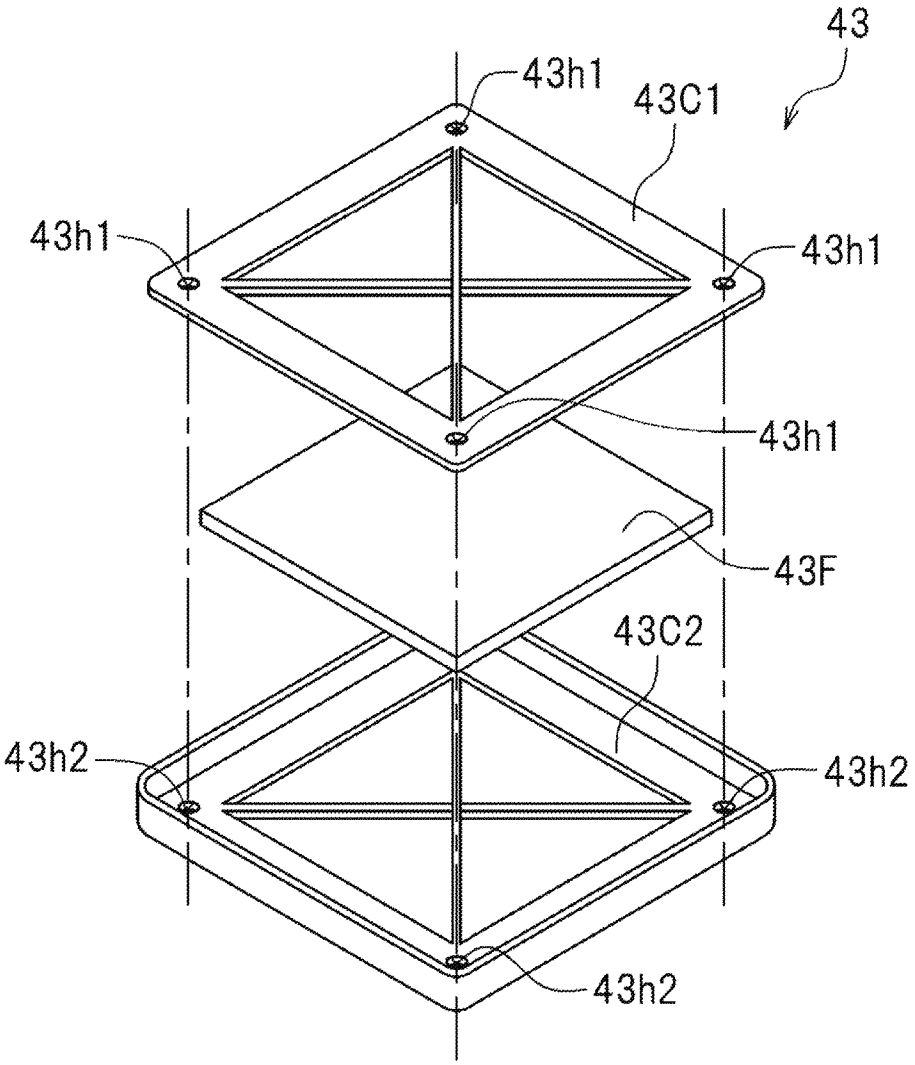
FIG. 6 is an exploded view, schematically illustrating a gas-liquid separator of FIG. 5.

In this preferred embodiment, the gas-liquid separator 43 preferably includes a gas-liquid separation filter 43F (refer to FIG. 6). FIG. 6 is an exploded view, schematically illustrating the gas-liquid separator 43. The gas-liquid separator 43 includes the gas-liquid separation filter 43F, and plate-shaped retention members 43C1 and 43C2 to support the gas-liquid separation filter 43F. For example, the gas-liquid separation filter 43F preferably is a porous sheet made from a nonwoven fabric or sponge. While one gas-liquid separation filter 43F is shown here, two or more gas-liquid separation filters 43F with different porosities may be used in combination, for example. The plate-shaped retention member 43C2 is provided along its circumference with a raised edge with a height equal to or greater than the thickness of the gas-liquid separation filter 43F. The gas-liquid separation filter 43F includes wider surfaces that are narrower than those of the plate-shaped retention members 43C1 and 43C2. The gas-liquid separation filter 43F is housed in a housing portion defined by a wider surface and the raised edge of the plate-shaped retention member 43C2. The gas-liquid separation filter 43F is sandwiched at its wider surfaces between the two plate-shaped retention members 43C1 and 43C2. In other words, in this preferred embodiment, the two plate-shaped retention members 43C1 and 43C2 define a case. The plate-shaped retention members 43C1 and 43C2 are provided with fixing holes 43*h*1 and 43*h*2, respectively, through their four corners. The gas-liquid separator 43 is fixed in the air passage 40 by screws inserted in the fixing holes 43*h*1 of the plate-shaped retention member 43C1 and the corresponding fixing holes 43*h*2 of the plate-shaped retention member 43C2.

The gas-liquid separation filter 43F traps ink from the ink mist that inertially collides with the gas-liquid separation filter 43F. The gas-liquid separation filter 43F is not communicated with the waste tank. The trapped ink from the ink mist stays on the gas-liquid separation filter 43F. The gas-liquid separation filter 43F is detachably fixed to the plate-shaped retention members 43C1 and 43C2. In other words, the gas-liquid separation filter 43F is replaceable. When the printer 1 is used for certain period of time, the user removes the screws from the fixing holes 43*h*1 and 43*h*2 of the plate-shaped retention members 43C1 and 43C2 to remove the gas-liquid separation filter 43F. Then, after replacing it with a new one, the user inserts the screws into the fixing holes 43*h*1 and 43*h*2 of the plate-shaped retention members 43C1 and 43C2 to fix the gas-liquid separation filter 43F in the air passage 40 again.

In this preferred embodiment, the gas-liquid separator 43 includes the separation filter 43F that traps ink from the ink mist as described above. In this preferred embodiment, the gas-liquid separator 43 includes the plate-shaped retention members 43C1 and 43C2 to house the separation filter 43F, and the separation filter 43F is detachably attached to the plate-shaped retention members 43C1 and 43C2. This configuration prevents the separated and collected ink from staying in the air passage 40 and impairing airflow and prevents the gas-liquid separation equipment from undergoing breakthrough, ensuring stable gas-liquid separation over a long period of time.

Preferred embodiments of the present invention have been described in the foregoing. However, the above preferred embodiments are shown for illustrative purposes only, and the present invention can be implemented in various other forms.

Figure 7:
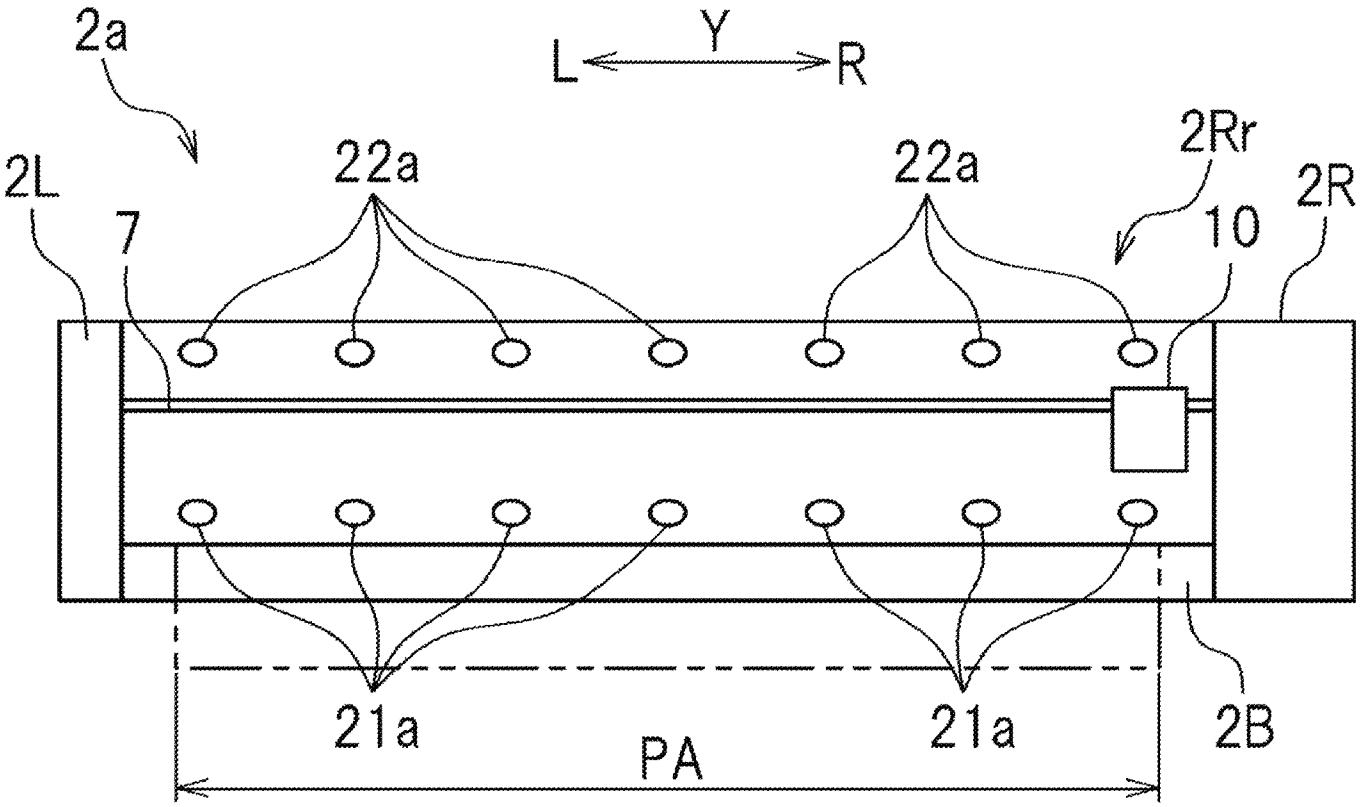
FIG. 7 is a front view, schematically illustrating a printer main unit according to yet another preferred embodiment of the present invention.

While the above preferred embodiments preferably include one air intake port 21, one air discharge port 22 and one air passage 20, for example, the numbers of these members are not limited to particular values. A plurality of air intake ports 21 and/or a plurality of air discharge ports 22 may be provided. The number of the air intake ports 21 and the number of the air discharge ports 22 may be the same or different. FIG. 7 is a front view of a printer main unit 2*a* according to another preferred embodiment. In this preferred embodiment, a plurality of air intake ports 21*a* and a plurality of air discharge ports 22*a* are provided in the main scanning direction Y. The plurality of air intake ports 21*a* and the plurality of air discharge ports 22*a* are arranged at regular intervals over the entire width of the printable region PA in the main scanning direction Y. Because the plurality of air intake ports 21*a* is provided along the printable region PA, ink mist is able to be drawn from a wide range in the main scanning direction Y along the recording medium P.

Each air intake port 21*a* is communicated with a corresponding one of the air discharge ports 22*a* via a dedicated air passage (not shown). In this preferred embodiment, the air intake port 21*a* and the air discharge port 22*a* disposed in the same position in the main scanning direction Y are communicated with each other. This configuration enables the gas-liquid separator (not shown) in each air passages to separate ink mist from air efficiently, and reduces the load on the motors of the blowers installed in the air passages to set the output power of the motors at a lower level. In this preferred embodiment, the number of the air intake ports 21*a*, the number of the air passages, and the number of the air discharge ports 22*a* preferably are the same. However, the numbers may be different from each other. For example, the number of the air passages may be the same as the number of the air intake ports 21*a* and/or the number of the air discharge ports 22*a*, and may be smaller than the number of the air intake ports 21*a* and/or the number of the air discharge ports 22*a*. The plurality of air intake ports 21*a* and the plurality of air discharge ports 22*a* may be connected at intermediate portions of the air passages.

In the above preferred embodiments, a so-called shuttle type (serial type) printer 1, in which the ejection head 11 is mounted on the carriage 10 and performs printing while reciprocating (shuttling) in the main scanning direction Y perpendicular to the direction in which the recording medium P is fed, is described, for example. However, the printer 1 is not limited to this type of printer. The techniques disclosed herein are also applicable to a line type printer including line head with the same width as a recording medium P, in which printing is performed with the line head fixed, for example.

In the above preferred embodiments, the carriage 10 is able to move in the main scanning direction Y and the recording medium P is able to move in the sub-scanning direction X. However, their moving directions are not particularly limited to those described above. The movement of the carriage 10 and the movement of the recording medium P are relative to each other. Either of the carriage 10 and the recording medium P may move either in the main scanning direction Y or in the sub-scanning direction X. For example, the recording medium P may be placed immovably and the carriage 10 may be movable in both the main scanning direction Y and the sub-scanning direction X. Both of the carriage 10 and the recording medium P may be movable in both the directions.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An inkjet printer, comprising:

an ejection head that ejects an ink onto a recording medium;

a passage in which an ink mist generated by the ejection head flows;

a gas-liquid separator that is located in a portion of the passage and separates ink and air from the ink mist; and a blower that is located in the passage and causes the ink mist to be moved away from the ejection head to the gas-liquid separator;

an air intake port upstream of the gas-liquid separator; and an air discharge port downstream of the gas-liquid separator; wherein the ejection head, the air intake port, and the air discharge port are all disposed within a printing space in a printer main unit of the inkjet printer; and the air intake port is below the air discharge port in a gravitational direction.

2. The inkjet printer according to claim 1, wherein the gas-liquid separator is positioned such that air flowing out of the gas-liquid separator from a downstream side moves in a direction opposite to the gravitational direction.

3. The inkjet printer according to claim 1, further comprising a cover that covers at least a portion of the ejection head.

4. The inkjet printer according to claim 3, wherein the cover is positioned to completely enclose the ejection head.

5. The inkjet printer according to claim 3, wherein the gas-liquid separator is located outside of the cover.

6. The inkjet printer according to claim 1, further comprising a mount table on which the recording medium is capable of being placed, wherein at least a portion of the air intake port is located above the mount table.

7. The inkjet printer according to claim 1, wherein at least a portion of the air discharge port is located above an upper end of the ejection head in the gravitational direction.

8. The inkjet printer according to claim 1, wherein the ejection head is located between the air intake port and the air discharge port in the gravitational direction.

9. The inkjet printer according to claim 1, wherein at least a portion of the gas-liquid separator is located between the air intake port and the air discharge port in the gravitational direction.

10. The inkjet printer according to claim 1, wherein the air intake port and the air discharge port are aligned in a direction perpendicular or substantially perpendicular to the gravitational direction.

11. The inkjet printer according to claim 1, wherein the gas-liquid separator is positioned such that air flowing out of the gas-liquid separator moves in a direction opposite to the gravitational direction.

12. The inkjet printer according to claim 1, wherein the blower sucks the ink mist away from the ejection head through the gas-liquid separator in a direction opposite to the gravitational direction.

13. The inkjet printer according to claim 1, wherein the passage includes a first portion in which the ink mist moves away from the ejection head in a first direction that is perpendicular or substantially perpendicular to the gravitational direction, a second portion in which the ink mist moves in a second direction opposite or substantially opposite to the gravitational direction and through the gas-liquid separator, and a third portion in which air separated by the gas-liquid separator from the ink mist moves in a third direction that is opposite to the first direction and is perpendicular or substantially perpendicular to the gravitational direction.

14. The inkjet printer according to claim 1, wherein:

the ejection head includes one or more nozzles; and the one or more nozzles of the ejection head are all located below the air discharge port in the gravitational direction.

15. The inkjet printer according to claim 1, wherein the printing space is defined by at least a plurality of wall portions of the printer main unit.

16. The inkjet printer according to claim 15, wherein the air intake port and the air discharge port are both located in one of the plurality of wall portions of the printer main unit.

* * * * *